US005397692A

United States Patent [19]

Suga

[11] Patent Number: 5,397,692

[45] Date of Patent: Mar. 14, 1995

[54] SILVER HALIDE PHOTOGRAPHIC LIGHT-SENSITIVE MATERIAL

[75] Inventor: Yoichi Suga, Minami-ashigara, Japan

[73] Assignee: Fuji Photo Film Co., Ltd., Kanagawa, Japan

[21] Appl. No.: 66,934

[22] Filed: May 25, 1993

Related U.S. Application Data

[63] Continuation of Ser. No. 705,378, May 24, 1991, abandoned.

[30] Foreign Application Priority Data

May 29, 1990 [JP] Japan ..... 2-139183

[51] Int. Cl.[6] ..... G03C 1/09

[52] U.S. Cl. ..... 430/567; 430/569; 430/603; 430/605

[58] Field of Search ..... 430/567, 569, 603, 605

[56] References Cited

U.S. PATENT DOCUMENTS

| | | | |
|---|---|---|---|
| 3,297,446 | 1/1967 | Dunn | 430/550 |
| 3,297,447 | 1/1967 | McVeigh | 430/543 |
| 3,979,213 | 9/1976 | Gilman, Jr. et al. | 430/570 |
| 4,414,306 | 11/1983 | Wey et al. | 430/434 |
| 4,414,310 | 11/1983 | Daubendiek et al. | 403/567 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,459,353 | 7/1984 | Maskasky | 430/567 |
| 4,490,458 | 12/1984 | House | 430/503 |
| 4,565,778 | 1/1986 | Miyamoto et al. | 430/567 |
| 4,923,793 | 5/1990 | Shibahara | 430/567 |
| 4,985,350 | 1/1991 | Ikeda et al. | 430/567 |
| 5,112,733 | 5/1992 | Ihama | 430/603 |
| 5,156,946 | 10/1992 | Nagaoka et al. | 430/567 |
| 5,166,045 | 11/1992 | Wu | 430/569 |
| 5,248,588 | 9/1993 | Nagaoka | 430/605 |
| 5,306,608 | 4/1994 | Kato | 430/547 |

FOREIGN PATENT DOCUMENTS

| | | | |
|---|---|---|---|
| 0428041 | 5/1991 | European Pat. Off. | 430/603 |
| 60-151637 | 8/1985 | Japan | 430/567 |
| 1224752 | 9/1989 | Japan | 430/567 |

*Primary Examiner*—Charles L. Bowers, Jr.
*Assistant Examiner*—John A. McPherson
*Attorney, Agent, or Firm*—Birch, Stewart, Kolasch & Birch

[57] ABSTRACT

A silver halide photographic light-sensitive material comprises, on a support, at least one negative silver halide emulsion layer containing silver halide grains which are subjected to selenium sensitization, have at least one peak value in internal sensitivity speck numbers in a distribution of sensitivity specks, the peak value being present at a depth of 2 nm to less than 50 nm from the surface of the grains, and have an average aspect ratio of less than 8.

16 Claims, No Drawings

SILVER HALIDE PHOTOGRAPHIC LIGHT-SENSITIVE MATERIAL

This application is a continuation of application Ser. No. 07/705,378, filed on May 24, 1991, now abandoned.

BACKGROUND OF THE INVENTION

1. Field of the Invention

The present invention relates to a light-sensitive silver halide emulsion having a high sensitivity and an improved graininess.

2. Description of the Related Art

Recently, the strictness of requirements for a photographic silver halide emulsion have been increased, and high-level requirements have been made for photographic properties, e.g., a high sensitivity, a high graininess, and a high sharpness. To satisfy these requirements, U.S. Pat. Nos. 4,434,226, 4,414,310, 4,433,048, 4,414,306, and 4,459,353 disclose techniques of using tabular grains for improving sensitivity including an improvement in color sensitization efficiency obtained by sensitizing dyes, sensitivity/graininess relationship, sharpness, and covering power. In addition, JP-A-58-113930 ("JP-A-" means Published Unexamined Japanese Patent Application), JP-A-58-113934, and JP-A-59-119350 disclose multilayered color photographic light-sensitive materials each using a tabular silver halide emulsion having an aspect ratio of 8 or more in a high-sensitivity layer and having a high sensitivity and improved graininess, sharpness, and color reproducibility.

Since, however, dyes have properties of desensitizing a silver halide emulsion, optimal spectral sensitization can be achieved in only an amount much smaller than an amount by which dyes can form a continuous monomolecular layer on the surface of each emulsion grain. Therefore, the merit of tabular grains is not effectively used under the present conditions.

It has been known for a long time that, in order to solve the above problem, a so-called internal latent image type emulsion having, inside a grain, a ripening speck (to be referred to as a "sensitivity speck" hereinafter) capable of forming a developable latent image upon exposure is effectively used. For example, U.S. Pat. No. 3,979,213 discloses the fact that the degree of desensitization of intrinsic sensitivity of an internal latent image type silver halide emulsion upon spectral sensitization is much smaller than that of a silver halide emulsion comprising grains which are equal in grain size to those of the internal latent image type silver halide emulsion and chemically sensitized only on their surfaces, and that therefore color sensitization can be effectively performed by using a large amount of color sensitizing dyes. In general, however, the sensitivity speck is said to be a very small crystal of, e.g., silver sulfide or gold sulfide epitaxially bonded to a silver halide crystal, and its existing state is unstable. Therefore, since the function as a sensitivity speck is sometimes degraded upon formation of internal latent image forming sites, the effect of improving sensitivity obtained by formation of the internal latent image forming sites is not satisfactorily achieved in conventional methods.

JP-B-44-15748 ("JP-B-" means Published Examined Japanese Patent Application) discloses a photographic silver halide emulsion sensitized by at least two types of different sensitizers, i.e., a noble metal sensitizer and an unstable selenium sensitizer.

JP-B-43-13489 discloses a photographic silver halide emulsion sensitized by at least three types of different sensitizers, i.e., a noble metal sensitizer, an unstable selenium sensitizer, and an unstable sulfur compound. However, the selenium sensitization easily produces fog, though it has a sensitizing effect superior to that of the sulfur sensitization.

SUMMARY OF THE INVENTION

It is an object of the present invention to provide a light-sensitive material containing an internal latent image type negative silver halide emulsion having improved sensitivity, graininess and storage stability.

The above object of the present invention is achieved by:

(1) A silver halide photographic light-sensitive material comprising, on a support, at least one negative silver halide emulsion layer containing silver halide grains which are subjected to selenium sensitization, have at least one peak value in internal sensitivity speck numbers in a distribution of sensitivity specks, the peak number being present at depth of 2 nm to less than 50 nm from the surface of the grains, and have an average aspect ratio of less than 8;

(2) The silver halide photographic light-sensitive material containing silver halide grains described in item (1) above, wherein the silver halide grains are further subjected to sulfur sensitization and gold sensitization; and (3) The silver halide photographic light-sensitive material described in item (1) above, wherein the silver halide grains have a sensitivity speck number at the surface, which is about 1/10 to 5/10 of the peak value in internal sensitivity speck numbers.

DETAILED DESCRIPTION OF THE PRESENT INVENTION

The present invention will be described in detail below.

Negative silver halide grains of the present invention have an average aspect ratio of less than 8. The grains may be those having regular crystal shapes (regular crystal grains) such as octahedral, dodecahedral, or tetradecahedral grains with an average aspect ratio of about 1, or those having irregular crystal shapes such as spherical or potato-like grains. The grains are preferably tabular grains with an aspect ratio of less than 8, and more preferably, tabular grains with an aspect ratio of more than 3 and less than 8. The tabular grain is a general term representing grains having one twinning crystal face or two or more parallel twinning crystal faces. In this case, when ions at all lattice points at two sides of a (111) face are in a mirror image relationship, this (111) face is called a twinning crystal face. When this tabular grain is viewed from the above, the shape of the grain is a triangle, a hexagon, or a circle obtained by rounding the triangle or hexagon. Triangular, hexagonal, and circular grains have triangular, hexagonal, and circular parallel surfaces, respectively.

In the present invention, an average aspect ratio of tabular grains having a grain size of 0.1 μm or more is an average value of values obtained by dividing grain sizes of the grains by their thicknesses. The thickness of each grain can be easily measured as follows. That is, a metal and a latex as a reference are obliquely deposited on a grain, and the length of a shadow is measured on an electron micrograph, thereby calculating the thickness of the grain in accordance with the length of the shadow of the latex.

In the present invention, the grain size is a diameter of a circle having an area equal to a projected area of parallel surfaces of a grain.

The projected area of a grain can be obtained by measuring an area on an electron micrograph and correcting a photographing magnification.

The diameter of the tabular grain is preferably 0.15 to 0.5 μm. The thickness of the tabular grain is preferably 0.05 to 1.0 μm.

A ratio occupied by the tabular grains is preferably 50% or more, more preferably, 80% or more, and most preferably 90% or more of the entire projected area.

More preferable results are sometimes obtained by using monodisperse tabular grains. Although a feature and a method of manufacturing the monodisperse tabular grains are described in, for example, JP-A-63-151618, the shape of the grain will be briefly described below. That is, 70% or more of the total projected area of silver halide grains are occupied by hexagonal tabular silver halide grains in which a ratio of the length of an edge having a maximum length to the length of an edge having a minimum length is 2 or less and which has two parallel faces as outer surfaces. The tabular silver halide grains are, preferably, monodisperse, i.e., have a variation coefficient (a value obtained by dividing a variation (standard deviation) in grain sizes represented by a circle-equivalent diameter of a projected area by an average grain size) in grain size distribution of 20% or less.

The diameter of a regular crystal grain is preferably 0.1 to 5.0 μm, and a variation coefficient in size distribution is preferably 20% or less.

The silver halide grain, especially, the tabular silver halide grain of the present invention preferably has dislocations.

Dislocations of a tabular grain can be observed by a direct method using a transmission electron microscope at a low temperature as described in, e.g., J. F. Hamilton, Phot. Sci. Eng., 11, 57, (1967) or T. Shiozawa, J. Soc. Phot. Sci. Japan, 35,213, (1972). That is, a silver halide grain extracted from an emulsion so as not to apply pressure enough to produce a dislocation in the grain is placed on a mesh for electron microscope observation, and observation is performed by a transmission method while a sample is cooled to prevent damage (e.g., print out) caused by an electron beam. In this case, since it becomes difficult to transmit an electron beam as the thickness of a grain is increased, the grain can be observed more clearly by using a high-voltage (200 kv or more with respect to a grain having a thickness of 0.25 μm) electron microscope. By using photographs of grains obtained by this method, the positions and number of dislocations of each grain when the grain is vertically viewed with respect to the major faces can be obtained.

These dislocations may be formed throughout the entire major faces or locally, selectively formed thereon.

The emulsion of the present invention is preferably a negative emulsion which produces development silver corresponding to an exposure amount and is distinguished from a positive emulsion.

A halogen composition of the silver halide grains of the present invention is silver iodobromide, silver bromide, or silver chloroiodobromide. A halogen structure inside a grain may be a uniform, double, or multiple structure, and a silver iodide rich phase may be present inside a grain, on the surface of a grain, or in an intermediate portion of a grain. In addition, the grain preferably has a halogen-converted silver halide, silver thiocyanate, or silver citrate layer inside the grain.

Selenium sensitization can be performed for the silver halide grains of the present invention by a conventional method. That is, a labile selenium compound and/or a non-labile selenium compound are/is added to an emulsion, and the emulsion is stirred at a high temperature of preferably 40° C. or more for a predetermined time period. Selenium sensitization using labile selenium sensitizers described in JP-B-44-15748 is preferably performed. Examples of the labile selenium sensitizer are aliphatic isoselenocyanates such as allylisoselenocyanate, selenoureaes, selenoketones, selenoamides, selenocarboxylic acids, esters, and selenophosphates. Most preferable examples of the labile selenium compound are as follows.

I. Colloidal metal selenium

II. Organic selenium compound (in which a selenium atom is double-bonded to a carbon atom of an organic compound by covalent bonding)

a. Isoselenocyanates e.g., an aliphatic isoselenocyanate such as allylisoselenocyanate b. Selenoureaes (including an enol type) e.g., an aliphatic selenourea such as methyl, ethyl, propyl, isopropyl, butyl, hexyl, octyl, dioctyl, tetramethyl, N-(β-carboxyethyl)-N',N'-dimethyl, N,N-dimethyl, diethyl, and dimethyl; an aromatic selenourea having one or more aromatic groups such as phenyl and tolyl; a heterocyclic selenourea having a heterocyclic group such as pyridyl and benzothiazolyl c. Selenoketones e.g., selenoacetone, selenoacetophenone, selenoketone in which an alkyl group is bonded to >C=Se, and selenobenzophenone d. Selenoamides e.g., selenoacetoamide e. Selenocarboxylic acid and ester e.g., 2-selenopropionic acid, 3-selenobutyric acid, and methyl 3-selenobutyrate III. Others a. Selenides e.g., diethylselenide, diethyldiselenide, and triphenylphosphineselenide b. Selenophosphates e.g., tri-p-tolylselenophosphate and tri-n-butylselenophosphate Although the preferable type of the labile selenium compound are enumerated above, the compound is not limited to the above examples. It is generally understood by those skilled in the art that the structure of the labile selenium compound as a sensitizer of a photographic emulsion is not so important as long as selenium is labile and that an organic portion of a selenium sensitizer molecule has no function except for a function of carrying selenium and allowing selenium to be present in a labile state in an emulsion. In the present invention, the labile selenium compound in such a wide range of general idea is effectively used.

Selenium sensitization using un-labile selenium sensitizers described in JP-B-46-4553, JP-B-52-34492 and JP-B-52-34491 is also performed. Examples of the unlabile selenium compound are selenious acid, potassium selenocyanide, selenazoles, quaternary ammonium salts of selenazoles, diarylselenide, diaryldiselenide, 2-thioselenazolizinedion, 2-selenooxozinethione, and derivatives of these compounds.

An un-labile selenium sensitizer and a thioselenazolizinedion compound described in JP-B-52-38408 are also effective.

These selenium sensitizers are dissolved in water, an organic solvent such as methanol or ethanol, or a solvent mixture thereof and added upon chemical sensitization. Preferably, the sensitizers are added before chemical sensitization except for selenium sensitization is started. The selenium sensitizers need not be used singly but may be used in combination of two or more types thereof. The labile and un-labile selenium compounds can be preferably used in combination.

Although an addition amount of the selenium sensitizer for use in the present invention changes in accordance with the activity of the selenium sensitizer or the temperature and time of ripening, it is preferably $1\times10^{-8}$ mol or more, and more preferably, $1\times10^{-7}$ to $5\times10^{-5}$ mol per mol of a silver halide. When the selenium sensitizer is used, the temperature of chemical ripening is preferably 45° C. or more, and more preferably, 50° C. to 80° C. The pAg and the pH may take arbitrary values. For example, the effect of the present invention can be obtained throughout a wide pH range of 4 to 9.

In the present invention, selenium sensitization can be performed more effectively in the presence of a silver halide solvent.

Examples of the silver halide solvent which can be used in the present invention are (a) organic thioethers described in, e.g., U.S. Pat. Nos. 3,271,157, 3,531,289, and 3,574,628, JP-A-54-1019, and JP-A-54-158917; (b) thiourea derivatives described in, e.g., JP-A-53-82408, JP-A-55-77737, and JP-A-55-2982; (c) a silver halide solvent having a thiocarbonyl group sandwiched by an oxygen or sulfur atom and a nitrogen atom described in JP-A-53-144319; (d) imidazoles described in JP-A-54-100717; (e) sulfite; and (f) thiocyanate.

Practical compounds of the solvent are listed in Table A (to be presented later).

Most preferable examples of the solvent are thiocyanate and tetramethylthiourea. An amount of the solvent changes in accordance with the type of a solvent. For example, a preferable amount of thiocyanate is $1\times10^{-4}$ to $1\times10^{-2}$ mol per mol of a silver halide.

In chemical sensitization of the silver halide grains of the present invention, one or both of sulfur sensitization and gold sensitization is or are performed in addition to selenium sensitization.

Sulfur sensitization is normally performed by adding a sulfur sensitizer to an emulsion and stirring the emulsion at a high temperature of preferably 40° C. or more for a predetermined time period.

Gold sensitization is normally performed by adding a gold sensitizer to an emulsion and stirring the emulsion at a high temperature of 40° C. or more for a predetermined time period.

Known compounds can be used as the sulfur sensitizer in sulfur sensitization. Examples of the sulfur sensitizer are thiosulfate, allylthiocarbamidothiourea, allylisothiacyanate, cystine, p-toluenethiosulfonate, and rhodanine. In addition, sulfur sensitizers described in e.g., U.S. Pat. Nos. 1,574,944, 2,410,689, 2,278,947, 2,728,668, 3,501,313, and 3,656,955, West German Patent 1,422,869, JP-B-56-24937, and JP-A-55-45016 can be used. An addition amount of the sulfur sensitizer need only be an amount sufficient to effectively increase the sensitivity of the emulsion. Although the amount changes throughout a wide range in accordance with various conditions such as a pH, a temperature, and the size of a silver halide grain, it is preferably $1\times10^{-7}$ to $5\times10^{-5}$ mol per mol of a silver halide.

An oxidation number of gold of a gold sensitizer for use in gold sensitization of the present invention may be +univalent or +trivalent, and gold compounds which are normally used as a gold sensitizer can be used in the present invention. Typical examples of the gold compound are chloroaurate, potassium chloroaurate, auric-trichloride, potassium auricthiocyanate, potassium iodoaurate, tetracyanoauric acid, ammonium aurothiocyanate, and pyridyltrilorogold.

Although an addition amount of the gold sensitizer changes in accordance with various conditions, it is preferably $1\times10^{-7}$ to $5\times10^{-5}$ mol per mol of a silver halide.

In chemical ripening, addition times and an addition order of the silver halide solvent, the selenium sensitizer, the sulfur sensitizer, and the gold sensitizer need not be particularly limited. For example, the above compounds can be added simultaneously or at different addition times in (preferably) an initial stage of chemical ripening or during chemical ripening. The compounds may be dissolved in water or an organic solvent which can be mixed in water, e.g., a solution of methanol, ethanol, or acetone, or a solution mixture thereof and added to an emulsion.

The silver halide grain of the present invention has a site capable of forming a developable latent image upon exposure, i.e., a sensitivity speck, inside the grain. A so-called internal latent image type emulsion according to the present invention will be described below. That is, in the internal latent image type emulsion, one peak value (i.e. the largest value) in internal sensitivity speck numbers is present in a sensitivity speck distribution in a grain, the position of this peak value is present at a depth of 2 to 50 nm, and preferably, 5 nm to 30 nm from the surface of the grain, and the number of internal sensitivity speck (latent image) on the surface of the grain is preferably 1/10 to 5/10 the peak value in internal sensitivity speck numbers.

In the "sensitivity speck distribution in a grain" described above, the abscissa indicates a depth (x nm) of a latent image from the surface of the grain, and the ordinate indicates the number (y) of latent images. The depth x is given by:

$$X=\frac{S}{2}\times\left\{1-\left(\frac{Ag_1}{Ag_0}\right)^{\frac{1}{3}}\right\}$$

S: an average grain size (nm) of a silver halide emulsion $Ag_1$: a residual silver amount obtained after the following treatment is performed for a nonexposed emulsion-coated sample $Ag_0$: a coating silver amount before the processing.

The number y is represented by a reciprocal of an exposure amount for giving a density of (fog+0.1) when the following processing is executed after 1/100-sec. white exposure. The treatment for obtaining the above latent image distribution is performed at 20° C. for seven minutes by adding 0 to 10 g/l of sodium thiosulfate to a treatment solution having the following composition.

| | |
|---|---|
| N-methyl-p-aminophenol sulfate | 2.5 g |
| Sodium L-ascorbate | 10 g |

-continued

| | |
|---|---|
| Sodium methaborate | 35 g |
| Potassium bromide | 1 g |
| Water to make | 1 l (pH = 9.6) |

By changing the amount of sodium thiosulfate from 0 to 10 g/l, the depth of a latent image from the surface of a silver halide grain developed during the processing changes to make it possible to confirm a change in number of latent images in the direction of depth.

If the depth of a sensitivity speck obtained as described above is 50 nm or more from the surface, development cannot be satisfactorily performed even by using a developing agent practically used with respect to a black/white, color negative, or color reversal light-sensitive material. As a result, a substantial sensitivity is degraded.

According to conventionally reported methods of preparing an internal latent image type emulsion, to control the thickness of a shell results in a change in ratio of a surface sensitivity to an internal sensitivity. However, the results of this study reveal the fact that, in order to obtain an optimal sensitivity with respect to a certain processing, it is preferable to control grain formation conditions so as to independently control the mode of a latent image distribution and the ratio of a surface sensitivity to an internal sensitivity.

For example, even when the peak value in internal sensitivity speck number in the internal sensitivity speck distribution (the latent image distribution) is present at a position of less than 50 nm, if the number of internal sensitivity speck (latent image) on the surface of the grain becomes 5/10 or more the peak value, the effect of spectral sensitization of an internal latent image type emulsion as described in U.S. Pat. No. 3,979,213 is undesirably degraded. If the number of internal sensitivity speck or latent image of the surface of the grain becomes 1/10 or less the peak value, development cannot be satisfactorily performed by using practical developing solutions, and no substantial sensitivity is obtained.

In addition, it becomes obvious that a conventional design basis of an internal latent image type silver halide grain is unsatisfactory to achieve an optimal sensitivity because it lays emphasis on only a difference between a sensitivity obtained when surface development is performed and that obtained when internal development is performed.

More specifically, even when the ratio of a surface sensitivity to an internal sensitivity remains unchanged (e.g., even when the surface sensitivity remains ½ the internal sensitivity), if the peak of the latent image distribution is present at a deep position of 50 nm or more, development is not enough performed by practical process, and a potential optimal sensitivity of the grains cannot be obtained.

As described above, a position where the peak of the latent image distribution is present is an essential factor of achieving an optimal sensitivity, and excellent internal latent image type silver halide grains can be designed when both the position of the peak and a difference between the number of latent images at the peak and the number of latent images on the surface of the grain are taken into consideration.

The above-mentioned practical processing solution is not a developer from which a silver halide solvent is removed to develop only surface latent images nor a developer containing a large amount of a silver halide solvent to develop internal latent images.

Methods of preparing an internal latent image type emulsion are described in U.S. Pat. No. 3,979,213, 3,966,476, 3,206,313, and 3,917,485, JP-B-43-29405, and JP-B-45-13259. In each of these methods, however, to prepare an emulsion having a latent image distribution falling within the scope of claims of the present invention, a chemical sensitization method, an amount of a silver halide to be precipitated after the chemical sensitization, and the precipitation conditions must be controlled.

Alternatively, silver halide fine grains may be added to form internal latent image type emulsion by Ostwald ripening.

More specifically, in U.S. Pat. No. 3,979,213, an internal latent image type emulsion is prepared by a method in which a silver halide is precipitated again by a controlled double jet method on emulsion grains having chemically sensitized surfaces. If a silver halide in an amount carried out in U.S. Pat. No. 3,979,213 is precipitated on grains, a ratio of a surface sensitivity to a total sensitivity becomes less than 1/10. Therefore, to obtain a latent image distribution of the present invention, an amount of a silver halide to be precipitated after the chemical sensitization is preferably smaller than that carried out in U.S. Pat. No. 3,979,213.

The silver halide emulsion of the present invention can be preferably reduction-sensitized during grain formation.

"Reduction sensitization is performed during grain formation of a silver halide emulsion" basically means that reduction sensitization is performed during nucleation, ripening, and growth. Reduction sensitization may be performed upon any of nucleation as an initial stage of grain formation, physical ripening, or growth. Most preferably, reduction sensitization is performed during growth of silver halide grains. In this case, reduction sensitization may be performed while silver halide grains are physically ripened or grown upon addition of water-soluble silver salt and water-soluble alkali halide. Alternatively, growth may be temporarily stopped to perform reduction sensitization and then performed again.

Reduction sensitization may be any of a method of adding a known reduction sensitizer to a silver halide emulsion, a method called silver ripening in which grains are grown or ripened in a low-pAg atmosphere having a pAg of 1 to 7, and a method called high-pH ripening in which grains are grown or ripened in a high-pH atmosphere having a pH of 8 to 11. These methods can be used in combination of two or more thereof.

The method of adding a reduction sensitizer is preferable since the level of reduction sensitization can be finely controlled.

Examples of the reduction sensitizer are stannous chloride, amines and polyamines, a hydrazine derivative, formamidinesulfinic acid, a silane compound, and a borane compound. In the present invention, these compounds may be selectively used or used in combination of two or more types thereof. Preferable compounds as the reduction sensitizer are stannous chloride, thiourea dioxide, dimethylamineborane, ascorbic acid, and an ascorbic acid derivative. Although an addition amount of the reduction sensitizer depends on emulsion manufacturing conditions, it is preferably $10^{-8}$ to $10^{-3}$ mol per mol of a silver halide.

The reduction sensitizer can be dissolved in water or a solvent such as alcohols, glycols, ketones, esters, or amides and added during grain formation. Although the reduction sensitizer may be added to a reactor vessel beforehand, it is preferably added at an arbitrary timing during grain formation. The reduction sensitizer may be added to an aqueous solution of water-soluble silver salt or water-soluble alkali halide, and the resultant aqueous solution may be used in grain formation. In addition, a solution of a reduction sensitizer may be added continuously or a plurality of times as grain formation progresses.

More preferably, a palladium compound in an amount of $5\times10^{-5}$ mol or more, and preferably, $10^{-3}$ mol or less per mol of a silver halide is added to the silver halide emulsion of the present invention after grain formation is finished.

In this case, the palladium compound is a palladium divalent or tetravalent salt. The palladium compound is preferably represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

Preferable examples of the palladium compound are $K_2PdCl_4$, $(NH_4)_2PdCl_6$, $Na_2PdCl_4$, $(NH_4)_2PdCl_4$, $Li_2PdCl_4$, $Na_2PdCl_6$, and $K_2PdBr_4$.

Most preferably, the palladium compound is used in combination of thiocyanic acid ions in an amount (mol) five times that of the palladium compound.

The silver halide emulsion of the present invention is preferably spectrally sensitized and used.

A methine dye is normally used as a spectral sensitizing dye for use in the present invention. The methine dye includes a cyanine dye, a merocyanine dye, a complex dye, a complex merocyanine dye, a holopolar cyanine dye, a hemicyanine dye, a styryl dye, and a hemioxonol dye. In these dyes, any nucleus normally used as a basic heterocyclic nucleus in cyanine dyes can be used. Examples of the nucleus are pyrroline, oxazoline, thiozoline, pyrrole, oxazole, thiazole, selenazole, imidazole, tetrazole, and pyridine; a nucleus obtained by fusing an alicyclic hydrocarbon ring to each of the above nuclei; and a nucleus obtained by fusing an aromatic hydrocarbon ring to each of the above nuclei, e.g., indolenine, benzindolenine, indole, benzoxadole, naphthooxadole, benzothiazole, naphthothiazole, benzoselenazole, benzimidazole, and quinoline. These nuclei may be substituted on a carbon atom.

For a merocyanine dye or complex merocyanine dye, a 5- or 6-membered heterocyclic nucleus, e.g., pyrazoline-5-one, thiohydantoin, 2-thiooxazoline-2,4-dione, thiazoline-2,4-dione, rhodanine, or thiobarbituric acid can be used as a nucleus having a ketonmethylene structure.

Of the above dyes, a dye most effectively used in the present invention is a cyanine dye. An example of a cyanine dye effectively used in the present invention is a dye represented by the following formula (I):

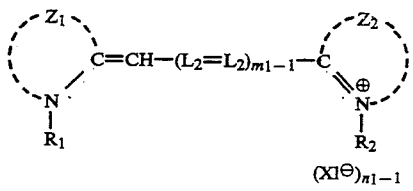

Formula (I)

wherein each of $Z_1$ and $Z_2$ independently represents an atom group required to complete a heterocyclic nucleus normally used in a cyanine dye, such as thiazole, thiazoline, benzothiazole, naphthothiazole, oxazole, oxazoline, benzooxazole, naphthooxazole, tetrazole, pyridine, quinoline, imidazoline, imidazole, benzoimidazole, naphthoimidazole, selenazoline, selenazole, benzoselenazole, naphthoselenazole, or indolenine. These nuclei may be substituted by a lower alkyl group such as methyl, a halogen atom, a phenyl group, a hydroxyl group, an alkoxy group having 1 to 4 carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, and a nitro group.

$L_1$ or $L_2$ represents a methine group and a substituted methine group. Examples of the substituted methine group are a methine group having a substituent group a lower alkyl group such as methyl and ethyl and phenyl, substituted phenyl, methoxy, and ethoxy.

Each of $R_1$ and $R_2$ independently represents an alkyl group having 1 to 5 carbon atoms; a substituted alkyl group having a carboxy group; a substituted alkyl group having a sulfo group such as β-sulfoethyl, γ-sulfopropyl, δ-sulfobutyl, 2-(3-sulfopropoxy)ethyl, 2-[2-(sulfopropoxy)ethoxy]ethyl, and 2-hydroxysulfopropyl, an allyl group or a substituted alkyl group normally used as an N-substituting group of a cyanine dye. $m_1$ represents 1, 2, or 3. $X_1$ represents an acid anion group normally used in a cyanine dye such as an iodine ion, a bromine ion, a p-toluenesulfonic acid ion, or a perchloric acid ion. $n_1$ represents 1 or 2. When a betaine structure is adopted, $n_1$ is 1.

The spectral sensitization is preferably performed by using two or more types of a sensitizing dye represented by formula (I).

In addition to the above sensitizing dyes, examples of the spectral sensitizing dye are described in, e.g., West German Patent 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862, and 4,026,344, British Patents 1,242,588, 1,344,281, and 1,507,803, JP-B-44-14030, JP-B-52-24844, JP-B-43-4936, JP-B-53-12375, JP-A-52-110618, JP-A-52-109925, and JP-A-50-80827.

An amount of the sensitizing dye to be added during preparation of the silver halide emulsion changes in accordance with the type of additive or a silver halide amount. However, an addition amount used in conventional methods, i.e., 50% to 80% of the saturated coating amount can be used.

That is, an addition amount of the sensitizing dye is preferably 0.001 to 100 mmol, and more preferably, 0.01 to 10 mmol per mol of a silver halide.

The sensitizing dye is added after or before chemical ripening. For the silver halide grains of the present invention, the sensitizing dye is most preferably added during chemical ripening or before chemical ripening (e.g., during grain formation or before physical ripening).

In addition to the sensitizing dye, a dye not having a spectral sensitizing effect or a substance essentially not absorbing visible light but exhibiting supersensitization may be added to the emulsion. Examples of the substance are an aminostyl compound substituted by a nitrogen-containing heterocyclic group (described in, e.g., U.S. Pat. No. 2,933,390 or 3,635,721), an aromatic organic acid formaldehyde condensate (described in, e.g., U.S. Pat. No. 3,743,510), cadmium salt, and an azaindene compound. Combinations described in U.S. Pat. Nos. 3,615,613, 3,615,641, 3,617,295, and 3,635,721 are most effective.

The photographic emulsion for use in the present invention can contain various compounds in order to prevent fog during manufacture, storage, or a photographic treatment of the light-sensitive material or to stabilize photographic properties. Examples of the compound known as an antifoggant or stabilizer are azoles such as benzothiazolium salt, nitroindazoles, triazoles, benzotriazoles, and benzimidazoles (especially a nitro- or halogen-substituted body); a heterocyclic mercapto compound such as mercaptothiazoles, mercaptobenzothiazoles, mercaptobenzimidazoles, mercaptothiazoles, mercaptotetrazoles (especially 1-phenyl-5-mercaptotetrazole), and mercaptopyrimidines; the heterocyclic mercapto compound having a water-soluble group such as a carboxyl group or a sulfone group; a thioketo compound such as oxazolinethion; azaindenes such as tetraazaindenes (especially 4-hydroxy-substituted(1,3,3a,7-)tetraazaindenes); benzenethiosulfonic acids; and benzenesulfinic acids.

Although these antifoggants or stabilizers are normally added after chemical ripening is performed, they may be more preferably added during chemical ripening or before start of chemical ripening. That is, in a silver halide emulsion grain formation process, the antifoggants or stabilizers can be added during addition of a silver salt solution, after the addition and before start of chemical ripening, or during chemical ripening (within preferably 50%, and more preferably, 20% of a chemical ripening time from the start of chemical ripening).

More specifically, examples of the antifoggant or stabilizer are a hydroxyazaindene compound, a benzotriazole compound, and a heterocyclic compound substituted by at least one mercapto group and having at least two azanitrogen atoms in a molecule.

The photographic emulsions for use in the present invention can be prepared by using methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating Photographic Emulsion", Focal Press, 1964. That is, the photographic emulsion can be prepared by, e.g., an acid method, a neutralization method, and an ammonia method. Also, as a system for reacting a soluble silver salt and a soluble halide, a single mixing method, a double mixing method, or a combination thereof can be used. Also, a so-called back mixing method for forming silver halide grains in the presence of excessive silver ions can be used. As one system of the double mixing method, a so-called controlled double jet method wherein the pAg in the liquid phase generated by the silver halide is kept at a constant value can be used. According to this method, a silver halide emulsion having a regular crystal form and almost uniform grain sizes is obtained.

The silver halide-emulsion containing the above-described regular silver halide grains can be obtained by controlling the pAg and pH during grain formation. More specifically,, such a method is described in "Photographic Science and Engineering", Vol. 6, 159–165 (1962); "Journal of Photographic Science", Vol. 12, 242–251 (1964); U.S. Pat. No. 3,655,394, and British Patent 1,413,748.

The tabular grain can be easily prepared by methods described in, e.g., Cleve, "Photography Theory and Practice", (1930), p. 131; Gutoff, "Photographic Science and Engineering", Vol. 14, PP. 248 to 257, (1970); and U.S. Pat. Nos. 4,434,226, 4,414,310, 4,433,048, and 4,439,520, and British Patent 2.112.157. when the tabular grain is used, covering power and a color sensitizing efficiency of a sensitizing dye can be advantageously improved as described in detail in U.S. Pat. No. 4,434,226.

In addition, a silver halide having a different composition may be bonded by an epitaxial junction or a compound except for a silver halide, e.g., silver rhodanide or zinc oxide may be bonded.

In the grains of the present invention, the shape of a core may be the same as or different from an entire shape with an outermost shell. More specifically, while the core is cubic, the grain shape with an outermost shell may be cubic or octahedral. On the contrary to this, while the core is octahedral, the grain with an outermost shell may be cubic or octahedral. In addition, while the core is a clear regular grain, the grain with an outermost shell may be slightly deformed or may not have any specific shape.

In a grain having the above structure, a boundary portion between different halogen compositions may be a clear boundary or an unclear boundary caused by a crystal mixture formed by a composition difference. Alternatively, a continuous structure change may be positively made.

The silver halide emulsion for use in the present invention can be subjected to a treatment for rounding a grain as disclosed in, e.g., EP-0096727B1 and EP-0064412B1 or a treatment of modifying the surface of a grain as disclosed in DE-2306447C2 and JP-A-60-221320.

A silver halide solvent can be effectively used to promote ripening. For example, in a known conventional method, an excessive amount of halogen ions are supplied in a reactor vessel in order to promote ripening. Therefore, it is apparent that ripening can be promoted by only supplying a silver halide solution into a reactor vessel. In addition, another ripening agent can be used. In this case, a total amount of these ripening agents can be mixed in a dispersion medium in the reactor vessel before a silver salt and a halide are added therein, or they can be added in the reactor vessel together with one or more halides, silver salts, or deflocculants. Alternatively, the ripening agents can be added in separate steps together with a halide and a silver salt.

Examples of the ripening agent except for the halogen ion are ammonia, an amine compound and a thiocyanate such as an alkali metal thiocyanate, especially sodium or potassium thiocyanate and ammonium thiocyanate.

During the process of silver halide grain formation or physical ripening of the silver halide emulsion of the present invention, cadmium salt, zinc salt, thallium salt, iridium salt or its complex salt, rhodium salt or its complex salt, or iron salt or iron complex salt may be present.

The photographic emulsion of the present invention can be applied to various types of color and black/-white light-sensitive materials. Typical examples are color negative films for general purposes and motion pictures, color reversal films for slides and TV, color paper, a color positive film, color reversal paper, a color diffusion type light-sensitive material, and a thermal development type color light-sensitive material.

The photographic emulsion of the present invention can also be applied to films for reprophotography such as a lith film and a scanner film, X-ray films for direct-/indirect medical purposes and industrial purposes, a photographic negative black/white film, black/white photographic printing paper, microfilms for COM and general purposes, a silver salt diffusion transfer type light-sensitive material, and a printout type light-sensitive material.

In a color light-sensitive material to which the photographic emulsion of the present invention is applied, at least one silver halide emulsion layer of a blue-sensitive layer, a green-sensitive layer, and a red-sensitive layer or a layer sensitive to infrared light need only be formed on a support, and the number and order of the silver halide emulsion layers and non-light-sensitive layers are not particularly limited. A typical example is a silver halide photographic light-sensitive material which has, on a support, at least one light-sensitive layer constituted by a plurality of silver halide emulsion layers sensitive to substantially the same color but having different sensitivities. This material can be effectively used as a light-sensitive material having an improved exposure latitude for photography. In a multilayered silver halide color photographic light-sensitive material, unit light-sensitive layers are generally arranged such that red-, green-, and blue-sensitive layers are formed in the order named from a support. However, the layers may be arranged in an opposite order or layers sensitive to the same color may sandwich a layer sensitive to a different color in accordance with the purpose.

Various types of non-light-sensitive layers such as interlayers may be formed between the silver halide light-sensitive layers or as the uppermost or lowermost layer.

The interlayer may contain couplers and DIR compounds as described in, e.g., JP-A-61-43748, JP-A-59-113438, JP-A-59-113440, JP-A-61-20037, and JP-A-61-20038 or may contain a color mixing inhibitor as when it is normally used.

As described in West German Patent 1,121,470 or British Patent 923,045, a two-layered arrangement constituted by high- and low-sensitivity emulsion layers can be preferably used as a plurality of silver halide emulsion layers constituting each unit light-sensitive layer. Normally, the layers are preferably arranged such that the sensitivity is sequentially decreased toward the support, and non-light-sensitive layers may be formed between the silver halide emulsion layers. Alternatively, the layers may be arranged such that a low-sensitivity layer is formed apart from the support while a high-sensitivity layer is formed close to the support, as described in JP-A-57-112751, JP-A-62-200350, JP-A-62-206541, and JP-A-62-206543.

More specifically, the layers may be arranged from the farthest side from the support in an order of low-sensitivity blue sensitive layer
(BL)/high-sensitivity blue sensitive layer
(BH)/high-sensitivity green sensitive layer
(GH)/low-sensitivity green sensitive layer
(GL)/high-sensitivity red sensitive layer
(RH)/low-sensitivity red sensitive layer (RL),
BH/BL/GL/GH/RH/RL, or
BH/BL/GH/GL/RL/RH.

In addition, the layers may be arranged from the farthest side from the support in an order of blue-sensitive layer/GH/RH/GL/RL as described in JP-B-55-34932 or an order of blue-sensitive layer/GL/RL/GH/RH as described in JP-A-56-25738 and JP-A-62-63936.

Also, as described in JP-B-49-15495, the layers may be arranged such that a silver halide emulsion layer having the highest sensitivity is formed as an upper layer, a silver halide emulsion layer having a sensitivity lower than that of the upper layer is formed as an intermediate layer, and a silver halide emulsion layer having a sensitivity lower than that of the intermediate layer is formed as a lower layer, i.e., the three layers may be arranged such that the sensitivity is sequentially decreased toward the support. Even in such an arrangement constituted by three layers having different sensitivities, as described in JP-A-59-202464, layers sensitive to the same color may be arranged from the farthest side from the support in an order of medium-sensitivity emulsion layer/high-sensitivity emulsion layer/low-sensitivity emulsion layer.

In order to improve color reproducibility, a donor layer (CL) with an interlayer effect having a spectral sensitivity distribution different from those of main light-sensitive layers such as BL, GL, and RL are preferably arranged adjacent to or close to the main light-sensitive layers.

When the present invention is applied to a color negative film or a color reversal film, a preferable silver halide contained in a photographic emulsion layer is silver iodobromide, silver iodochloride, or silver iodochlorobromide each containing about 30 mol % or less of average silver iodide. The most preferable silver halide is silver iodobromide or silver iodochlorobromide each containing about 2 to about 25 mol % of average silver iodide.

Although an average grain size of the photographic emulsion of the present invention is arbitrarily selected, a projected area diameter is preferably 0.5 to 4 μm. The emulsion may be either polydisperse or monodisperse emulsion.

Known photographic additives which can be used together with the photographic emulsion of the present invention are described in two Research Disclosures, and they are summarized in the following table.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23-24 | page 648, right column to page 649, right column |
| 4. Brighteners | page 24 | |
| 5. Antifoggants and stabilizers | pages 24-25<br>pages 24–25 | page 649, right column |
| 6. Light absorbent, filter dye, ultraviolet absorbents | pages 25-26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | " |
| 11. Plasticizers, lubricants | page 27 | page 650, right column |
| 12. Coating aids, | pages 26-27 | page 650, right |

-continued

| Additives | RD No. 17643 | RD No. 18716 |
|---|---|---|
| surface active agents | | column |
| 13. Antistatic agents | page 27 | page 650, right column |

In order to prevent degradation in photographic properties caused by formaldehyde gas, a compound which can react with and fix formaldehyde described in U.S. Pat. No. 4,411,987 or 4,435,503 is preferably added to the light-sensitive material.

The photographic emulsion of the present invention is preferably used in a color light-sensitive material, and various color couplers can be used. Specific examples of these couplers are described in above-described Research Disclosure (RD), No. 17643, VII-C to VII-G as patent references.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 04795/88.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, EP Disclosure 3,329,729, EP 121,365A and 249,453A; U.S. Pat. Nos. 3,446,622, 4,333,999, 4,775,616, 4,451,559, 4,427,767, 4,690,889, 4,254,212, and 4,296,199, and JP-A-61-42658.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. Pat. Nos. 3,451,820, 4,080,221, 4,367,288, 4,409,320, and 4,576,910, and British Patent 2,102,173.

Couplers releasing a photographically useful residue upon coupling are also preferably used in the present invention. DIR couplers, i.e., couplers releasing a development inhibitor are described in the patents cited in the above-described Research Disclosure No. 17643, VII-F, JP-A-57-151944, JP-A-57-154234, JP-A-60-184248, JP-A-63-37346, JP-A-63-37350, and U.S. Pat. Nos. 4,248,962 and 4,782,012.

In addition to the above couplers, examples of a coupler which can be used in the light-sensitive material of the present invention are competing couplers described in, e.g., U.S. Pat. No. 4,130,427; polyequivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24525; couplers releasing a dye which turns to a colored form after being released described in EP 173,302A and 313,308A; bleaching accelerator releasing couplers described in, e.g., RD. Nos. 11,449 and 24,241 and JP-A-61-201247; a legand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

A support which can be suitably used in the present invention is described in, e.g., RD. No. 17643, page 28 and RD. No. 18716, from the right column, page 647 to the left column, page 648.

In the light-sensitive material using the photographic emulsion of the present invention, the sum total of film thicknesses of all hydrophilic colloidal layers at the side having emulsion layers is preferably 28 μm or less, more preferably, 23 μm or less, and most preferably, 20 μm or less. A film swell speed $T_{\frac{1}{2}}$ is preferably 30 sec. or less, and more preferably, 20 sec. or less. The "film thickness" means a film thickness measured under moisture conditioning at a temperature of 25° C. and a relative humidity of 55% (two days). The film swell speed $T_{\frac{1}{2}}$ can be measured in accordance with a known method in this field of art. For example, the film swell speed $T_{\frac{1}{2}}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

The color photographic light-sensitive material according to the present invention can be developed by conventional methods described in RD. No. 17643, pp. 28 and 29 and RD. No. 18716, the left to right columns, page 615.

In order to perform reversal development, black-and-white development is performed and then color development is performed. As a black-and-white developer, known black-and-white developing agents, e.g., a dihydroxybenzene such as hydroquinone, a 3-pyrazolidone such as 1-phenyl-3-pyrazolidone, and aminophenol such as N-methyl-p-aminophenol can be used singly or in a combination of two or more thereof.

The photographic light-sensitive material of the present invention is normally subjected to washing and/or stabilizing steps after desilvering. An amount of water used in the washing step can be arbitrarily determined over a broad range in accordance with the properties (according to, e.g., the materials used such as couplers) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248 to 253 (May, 1955).

According to the above-described multi-stage counter-current scheme, the amount of water used for washing can be greatly decreased. Since, however, washing water stays in the tanks for a long period of time, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazoles described in JP-A-57-8542, a chlorine-based germicide such as chlorinated sodium isocyanurate, and germicides such as benzotriazole described in Hiroshi Horiguchi, "Chemistry of Antibacterial and Antifungal Agents" (1986), Sankyo Shuppan, Eiseigijutsu-Kai ed., "Sterilization, Antibacterial, and Antifungal Techniques for Microorganisms" (1982), Industrial Technology Society, and Nippon Bokin Bokabi Gakkai ed., "Dictionary of Antibacterial and Antifungal Agents" (1986) can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water washing. All known methods described in JP-A-57-8543, JP-A-58-14834, and JP-A-60-220345 can be used in such stabilizing processing.

Stabilizing is sometimes performed subsequently to washing. An example is a formalin bath used as a final bath of a photographic color light-sensitive material.

The present invention will be described in more detail below by way of its examples.

EXAMPLE 1

(1) Preparation of Emulsion

Substrate Emulsion:

6 g of potassium bromide and 30 g of inactive gelatin were dissolved in 3.7 l of distilled water to prepare an aqueous solution, and a 14% aqueous potassium bromide solution and a 20% aqueous silver nitrate solution were added to the above aqueous solution under stirring by a double jet method at a constant flow rates over one minute while the temperature and the pBr were maintained at 55° C. and 1.0, respectively (in this addition (I), 2.40% of the total silver amount were consumed). After an aqueous gelatin solution (17%, 300 cc) was added and the resultant solution was stirred at 55° C., a 20% aqueous silver nitrate solution was added at a constant flow rate until the pBr reached 1.40 (in this addition (II), 5.0% of the total silver amount were consumed). Subsequently, a 20% potassium bromide solution containing potassium iodide and a 33% aqueous silver nitrate solution were added by the double jet method over 80 minutes so as to add 8.3 g of potassium bromide (in this addition (III), 92.6% of the total silver amount were consumed). During the addition, the temperature and the pBr were maintained at 55° C. and 1.50, respectively. A silver nitrate amount used in this emulsion was 425 g. Desalting was performed by a normal flocculation method to prepare a tabular silver iodobromide substrate emulsion A (AgI=2.0 mol %) with an aspect ratio of 6.5 and a sphere-equivalent diameter of 0.8 μm.

Emulsion A:

Chemical sensitization was optimally performed for the substrate emulsion using $7\times10^{-6}$ mol/mol Ag of sodium thiosulfate, $9\times10^{-5}$ mol/mol Ag of potassium thiocyanate, and $1\times10^{-5}$ mol/mol Ag of chloroauric acid, to prepare an emulsion A.

Emulsion B:

After the chemical sensitization of the emulsion A, an aqueous silver nitrate solution and an aqueous potassium bromide solution were added by the double jet method to form a shell with a thickness of 5 nm, to prepare an emulsion B.

Emulsion C:

Chemical sensitization was performed by using $5\times10^{-6}$ mol/mol Ag of dimethylselenourea in place of sodium thiosulfate of the chemical sensitizers of the emulsion A, to prepare an emulsion C.

Emulsion D:

Chemical sensitization was performed by using $3\times10^{-6}$ mol/mol Ag of sodium thiosulfate and $5\times10^{-6}$ mol/mol Ag of dimethylselenourea in place of sodium thiosulfate of the chemical sensitizers of the emulsion A, to prepare an emulsion D.

Emulsion E:

After the chemical sensitization was performed for the emulsion C, a shell was formed following the same procedures as for the emulsion B, to prepare an emulsion E.

Emulsion F:

After the chemical sensitization was performed for the emulsion D, a shell was formed following the same procedures as for the emulsion B, to prepare an emulsion F.

Emulsion G:

The emulsion G was prepared following the same procedures as for the emulsion F except that the shell thickness after the chemical sensitization was 40 nm.

Emulsion H:

The emulsion H was prepared following the same procedures as for the emulsion F except that the shell thickness after the chemical sensitization was 70 nm.

Emulsion I:

The pBr during grain formation of the substrate emulsion in the preparation of the emulsion D was controlled to prepare an emulsion with an aspect ratio of 12, to prepare an emulsion I.

Emulsion J:

The pBr during grain formation of the base emulsion in the preparation of the emulsion F was controlled to prepare an emulsion with an aspect ratio of 12, to prepare an emulsion J.

$6\times10^{-4}$ mol/mol Ag of a sensitizing dye A were added to the emulsions A to J at 60° C. (Sample Nos. 1 to 10)

Sensitizing dye A

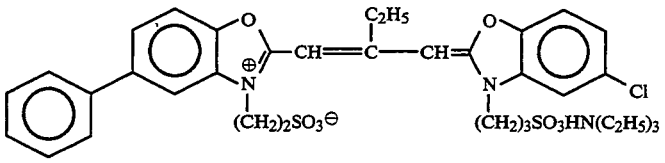

In addition, $6\times10^{-4}$ mol/mol Ag of a solution mixture (A/B=4/1) of the above sensitizing dye A and the following sensitizing dye B were added to the emulsion F at 60° C. (Sample No. 11).

Sensitizing dye B

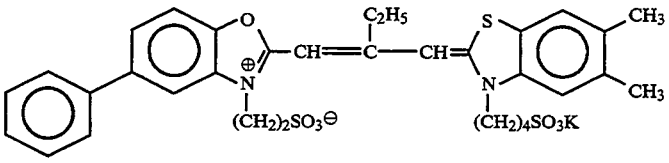

Each emulsion was coated on a triacetylcellulose film support with an undercoating layer in a coating amount as shown in Table 1.

TABLE 1

| Emulsion Coating Conditions | |
|---|---|
| (1) Emulsion Layer | |
| Emulsion . . . Various types of emulsions | (silver $2.1\times10^{-2}$ mol/m$^2$) |
| Coupler | ($1.5\times10^{-3}$ mol/m$^2$) |

TABLE 1-continued

| Emulsion Coating Conditions | |
|---|---|
| 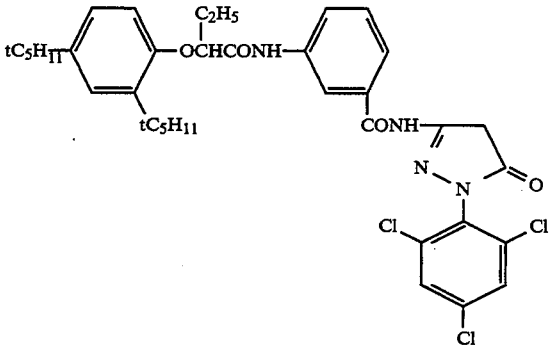 | |
| Tricresylphosphate | (1.10 g/m$^2$) |
| Gelatin | (2.30 g/m$^2$) |
| (2) Protective Layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours and exposed for 1/100 second through an interference filter of 390 nm and a continuous wedge, and the following color development was performed.

The densities of the developed samples were measured by using a green filter.

| Step | Time | Temperature |
|---|---|---|
| Color development | 2 min. 00 sec. | 40° C. |
| Bleach-fixing | 3 min. 00 sec. | 40° C. |
| Water-Washing (1) | 20 sec. | 35° C. |
| Water-Washing (2) | 20 sec. | 35° C. |
| Stabilizing | 20 sec. | 35° C. |
| Drying | 50 sec. | 65° C. |

The processing solution compositions will be described below.

| | (g) |
|---|---|
| (Color Developing Solution) | |
| Diethylenetriaminepentaacetic acid | 2.0 |

-continued

| | (g) |
|---|---|
| 1-hydroxyethylidene-1,1-diphosphonic acid | 3.0 |
| Sodium sulfite | 4.0 |
| Potassium carbonate | 30.0 |
| Potassium Bromide | 1.4 |
| Potassium Iodide | 1.5 mg |
| Hydroxylamine sulfate | 2.4 |
| 4-[N-ethyl-N-(β-hydroxyethyl)amino]-2-methylaniline sulfate | 4.5 |
| Water to make | 1.0 l |
| pH | 10.05 |
| (Bleach-Fixing Solution) | |
| Ferric ammonium ethylenediaminetetraacetate (dihydrate) | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator | 0.01 mol |

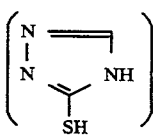

| | |
|---|---|
| Water to make | 1.0 l |
| pH | 6.0 |
| (Washing Solution) | |
| Tap water was supplied to a mixed-bed column filled with an H type strongly acidic cation exchange resin (Amberlite IR-120B: available from Rohm & House Co.) and an OH type strongly basic anion exchange resin (Amberlite IR-400) to set the concentrations of calcium and magnesium to be 3 mg/l or less. Subsequently, 20 mg/l of sodium dichloro isocyanurate and 1.5 g/l of sodium surface were added. The pH of the solution fell within the range of 3.5 to 7.5. | |
| (Stabilizing Solution) | |
| Formalin (37%) | 2.0 ml |
| Polyoxyethylene-p-monononyl-phenylether (average polymerization degree = 10) | 0.3 |
| Disodium ethylenediaminetetraacetate | 0.05 |
| Water to make | 1.0 l |
| pH | 5.0 to 8.0 |

The sensitivity is represented by a relative value of a reciprocal of an exposure amount (lux·sec.) for giving a density of fog+0.2.

The obtained results are summarized in Table 2.

TABLE 2

| Sample No. | Emulsion Name | Chemical Sensitizer | Aspect Ratio | Shell Thickness* | Sensitivity | Fog | Sensitizing Dye |
|---|---|---|---|---|---|---|---|
| 1 (Comparative Example) | A | Sulfur + Gold | 6.5 | — | 100 | 0.15 | A |
| 2 (Comparative Example) | B | Sulfur + Gold | 6.5 | 5 nm | 85 | 0.12 | A |
| 3 (Comparative Example) | C | Selenium + Gold | 6.5 | — | 110 | 0.50 | A |
| 4 (Comparative Example) | D | Sulfur + Selenium + Gold | 6.5 | — | 103 | 0.30 | A |
| 5 (Present Invention) | E | Selenium + Gold | 6.5 | 5 nm | 130 | 0.25 | A |
| 6 (Present Invention) | F | Sulfur + Selenium + Gold | 6.5 | 5 nm | 130 | 0.20 | A |
| 7 (Present Invention) | G | Sulfur + Selenium + Gold | 6.5 | 40 nm | 120 | 0.18 | A |
| 8 (Comparative Example) | H | Sulfur + Selenium + Gold | 6.5 | 70 nm | 90 | 0.12 | A |
| 9 (Comparative Example) | I | Sulfur + Selenium + Gold | 12 | — | 95 | 0.30 | A |
| 10 (Comparative Example) | J | Sulfur + Selenium + Gold | 12 | 5 nm | 95 | 0.30 | A |
| 11 (Present Invention) | K | Sulfur + Selenium + Gold | 6.5 | 5 nm | 140 | 0.30 | A + B |

*The shell thickness corresponds to a position of a peak value in the direction of depth in a sensitivity speck distribution.

From the above results, it is found that the specific sensitivity is increased when a shell is formed and this effect is enhanced when sulfur, selenium, and gold are simultaneously used and is further enhanced when two types of sensitizing dyes are simultaneously used.

EXAMPLE 2

Emulsions shown in Tables 3 and 4 were used to coat a plurality of layers having the following compositions on undercoated triacetylcellulose film supports, thereby forming samples 101 to 104 as multilayered color light-sensitive materials.

(Compositions of Light-Sensitive Layers)

Numerals corresponding to the respective components indicate coating amounts in units of g/m². The silver halide is represented by a silver coating amount. A coating amount of the sensitizing dye is represented in units of mols per mol of the silver halide in the same layer.

(Samples 101–104)

| | | |
|---|---|---|
| **Layer 1: Antihalation Layer** | | |
| Black colloidal silver | silver | 0.18 |
| Gelatin | | 1.40 |
| **Layer 2: Interlayer** | | |
| 2,5-di-t-pentadecylhydroquinone | | 0.18 |
| EX-1 | | 0.07 |
| EX-3 | | 0.02 |
| EX-12 | | 0.002 |
| U-1 | | 0.06 |
| U-2 | | 0.08 |
| U-3 | | 0.10 |
| HBS-1 | | 0.10 |
| HBS-2 | | 0.02 |
| Gelatin | | 1.04 |
| **Layer 3: Donor Layer with Interlayer Effect on Red-Sensitive Layer** | | |
| Emulsion (1) | silver | 1.2 |
| Emulsion (2) | silver | 2.0 |
| Sensitizing dye IV | | $4 \times 10^{-4}$ |
| EX-10 | | 0.10 |
| HBS-1 | | 0.10 |
| HBS-2 | | 0.10 |
| **Layer 4: Interlayer** | | |
| EX- 5 | | 0.040 |
| HBS-1 | | 0.020 |
| Gelatin | | 0.80 |
| **Layer 5: 1st Red-Sensitive Emulsion Layer** | | |
| Emulsion (3) | silver | 0.25 |
| Emulsion (4) | silver | 0.25 |
| Sensitizing dye I | | $1.5 \times 10^{-4}$ |
| Sensitizing dye II | | $1.8 \times 10^{-5}$ |
| Sensitizing dye III | | $2.5 \times 10^{-4}$ |
| EX-2 | | 0.335 |
| EX-10 | | 0.020 |
| U-1 | | 0.07 |
| U-2 | | 0.05 |
| U-3 | | 0.07 |
| HBS-1 | | 0.060 |
| Gelatin | | 0.87 |
| **Layer 6: 2nd Red-Sensitive Emulsion Layer** | | |
| Emulsion (5) | silver | 1.0 |
| Sensitizing dye I | | $1.0 \times 10^{-4}$ |
| Sensitizing dye II | | $1.4 \times 10^{-5}$ |
| Sensitizing dye III | | $2.0 \times 10^{-4}$ |
| EX-2 | | 0.400 |
| EX-3 | | 0.050 |
| EX-10 | | 0.015 |
| U-1 | | 0.07 |
| U-2 | | 0.05 |
| U-3 | | 0.07 |
| Gelatin | | 1.30 |
| **Layer 7: 3rd Red-Sensitive Emulsion Layer** | | |
| Emulsion listed in Table 4 | silver | 1.60 |
| Sensitizing dye I | | $2.0 \times 10^{-4}$ |
| Sensitizing dye II | | $2.8 \times 10^{-5}$ |
| Sensitizing dye III | | $4.0 \times 10^{-4}$ |
| EX-3 | | 0.010 |
| EX-4 | | 0.080 |
| EX-2 | | 0.097 |
| HBS-1 | | 0.22 |
| HBS-2 | | 0.10 |
| Gelatin | | 1.63 |
| **Layer 8: Interlayer** | | |
| EX-5 | | 0.040 |
| HBS-1 | | 0.020 |
| Gelatin | | 0.80 |
| **Layer 9: 1st Green-Sensitive Emulsion Layer** | | |
| Emulsion (3) | silver | 0.15 |
| Emulsion (4) | silver | 0.15 |
| Sensitizing dye V | | $3.0 \times 10^{-5}$ |
| Sensitizing dye VI | | $1.0 \times 10^{-4}$ |
| Sensitizing dye VII | | $3.8 \times 10^{-4}$ |
| Sensitizing dye IV | | $5.0 \times 10^{-5}$ |
| EX-6 | | 0.260 |
| EX-1 | | 0.021 |
| EX-7 | | 0.030 |
| EX-8 | | 0.005 |
| HBS-1 | | 0.100 |
| HBS-3 | | 0.010 |
| Gelatin | | 0.63 |
| **Layer 10: 2nd Green-Sensitive Emulsion Layer** | | |
| Emulsion (4) | silver | 0.45 |
| Sensitizing dye v | | $2.1 \times 10^{-5}$ |
| Sensitizing dye VI | | $7.0 \times 10^{-5}$ |
| Sensitizing dye VII | | $2.6 \times 10^{-4}$ |
| Sensitizing dye IV | | $5.0 \times 10^{-5}$ |
| EX-6 | | 0.094 |
| EX-22 | | 0.018 |
| EX-7 | | 0.026 |
| HBS-1 | | 0.160 |
| HBS-3 | | 0.008 |
| Gelatin | | 0.50 |
| **Layer 11: 3rd Green-Sensitive Emulsion Layer** | | |
| Emulsion listed in Table 4 | silver | 1.2 |
| Sensitizing dye V | | $7.0 \times 10^{-5}$ |
| Sensitizing dye VI | | $1.6 \times 10^{-5}$ |
| Sensitizing dye VII | | $6.0 \times 10^{-4}$ |
| Sensitizing dye IV | | $1.0 \times 10^{-5}$ |
| EX-13 | | 0.015 |
| EX-11 | | 0.100 |
| EX-1 | | 0.025 |
| HBS-1 | | 0.25 |
| HBS-2 | | 0.10 |
| Gelatin | | 1.54 |
| **Layer 12: Yellow Filter Layer** | | |
| Yellow colloidal silver | silver | 0.05 |
| EX-5 | | 0.08 |
| HBS-1 | | 0.03 |
| Gelatin | | 0.95 |
| **Layer 13: 1st Blue-Sensitive Emulsion Layer** | | |
| Emulsion (3) | silver | 0.08 |
| Emulsion (4) | silver | 0.07 |
| Emulsion (8) | silver | 0.07 |
| Sensitizing dye VIII | | $3.5 \times 10^{-4}$ |
| EX-9 | | 0.721 |
| EX-8 | | 0.042 |
| HBS-1 | | 0.28 |
| Gelatin | | 1.10 |
| **Layer 14: 2nd Blue-Sensitive Emulsion Layer** | | |
| Emulsion (5) | silver | 0.45 |
| Sensitizing dye VIII | | $2.1 \times 10^{-4}$ |
| EX-9 | | 0.154 |
| EX-10 | | 0.007 |
| HBS-1 | | 0.05 |
| Gelatin | | 0.78 |
| **Layer 15: 3rd Blue-Sensitive Emulsion Layer** | | |
| Emulsion (1) | silver | 0.77 |
| Sensitizing dye VIII | | $2.2 \times 10^{-4}$ |
| EX-9 | | 0.20 |
| HBS-1 | | 0.07 |
| Gelatin | | 0.69 |
| **Layer 16: 1st Protective Layer** | | |
| Emulsion (9) | silver | 0.20 |
| U-4 | | 0.11 |
| U-5 | | 0.17 |
| HBS-1 | | 0.05 |
| Gelatin | | 1.00 |
| **Layer 17: 2nd Protective Layer** | | |
| Polymethylacrylate grains (diameter = about 1.5 μm) | | 0.54 |
| S-1 | | 0.20 |
| Gelatin | | 1.20 |

In addition to the above components, a gelatin hardener H-1, compounds EX-14 to EX-21, and a surfactant were added to each layer. The emulsions (1) to (9) used in the formation of the samples were as shown in Table 3. The formulas of the compounds used are listed in Table B (to be presented later).

TABLE 3

| Emulsion No. | Average AgI Content (%) | Average Grain Size (mm) | Variation Coefficient according to Grain Size (%) | Diameter/ Thickness Ratio | Silver Amount Ratio (AgI Content) |
|---|---|---|---|---|---|
| (1) | 14.5 | 1.30 | 25 | 3 | Core/Shell = 37/63(34/3), Double Structure Grain |
| (2) | 10.0 | 0.75 | 30 | 2 | Core/Shell = ½(24/3), Double Structure Grain |
| (3) | 4.0 | 0.45 | 27 | 1 | Core Shell = ⅓(13/1), Double Structure Grain |
| (4) | 8.9 | 0.70 | 14 | 1 | Core/Shell = 3/7(25/2), Double Structure Grain |
| (5) | 14.0 | 0.75 | 25 | 2 | Core/Shell = ½(42/0), Double Structure Grain |
| (6) | 16.0 | 1.05 | 35 | 2 | Core/Shell = 4/6(40/0), Double Structure Grain |
| (7) | 10.0 | 1.05 | 35 | 3 | Core/Shell = ½(24/3), Double Structure Grain |
| (8) | 4.0 | 0.25 | 28 | 1 | Core/Shell = ⅓(13/1), Double Structure Grain |
| (9) | 1.0 | 0.07 | 15 | 1 | Uniform Grain |

All of sensitivity specks of emulsions (1) to (8) are present on silver halide grain surfaces.

TABLE 4

| Sample No. | Emulsion of Layer 7 | Emulsion of Layer 11 |
|---|---|---|
| 101 (Comparative Example) | Emulsion A in Example 1 | Emulsion (7) in Table 3 |
| 102 (Present Invention) | Emulsion G in Example 1 | Emulsion (7) in Table 3 |
| 103 (Comparative Example) | Emulsion (6) in Table 3 | Emulsion A in Example 1 |
| 104 (Present Invention) | Emulsion (6) in Table 3 | Emulsion F in Example 1 |

Note that the amounts of the sensitizing dyes used in the emulsion (7) of the samples 101 and 102 and the emulsion (6) of the samples 103 and 104 were multiplied by 0.6 and 0.7, respectively, to obtain the highest sensitivity of the plurality of coated samples.

The color photographic light-sensitive material samples 101 to 104 formed as described above were subjected to white exposure and then developed by the following method.

Processing Method

| Process | Time | Temperature | Replenishing Amount | Tank Volume |
|---|---|---|---|---|
| Color Development | 3 min. 15 sec. | 38° C. | 15 ml | 20 l |
| Bleaching | 6 min. 30 sec. | 38° C. | 10 ml | 40 l |
| Water-Washing | 2 min. 10 sec. | 35° C. | 10 ml | 20 l |
| Fixing | 4 min. 20 sec. | 38° C. | 20 ml | 30 l |
| Washing (1) | 1 min. 05 sec. | 35° C. | Counter flow piping from (2) to (1) | 10 l |
| Washing (2) | 1 min. 00 sec. | 35° C. | 20 ml | 10 l |
| Stabilizing | 1 min. 05 sec. | 38° C. | 10 ml | 10 l |
| Drying | 4 min. 20 sec. | 55° C. | | |

The replenishing amount is represented by an amount per meter of a 35-mm wide sample.

The compositions of the processing solutions will be presented below.

| | Mother Solution (g) | Replenishment Solution (g) |
|---|---|---|
| Color Developing Solution: | | |
| Diethylenetriamine-pentaacetate | 1.0 | 1.1 |
| 1-hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine sulfate | 2.4 | 3.6 |
| 4-(N-ethyl-N-β-hydroxylethylamino)-2-methylaniline sulfate | 4.5 | 7.2 |
| Water to make | 1.0 l | 1.0 l |
| pH | 10.05 | 10.10 |
| Bleaching Solution: | | |
| Ferric Sodium ethylenediamine-tetraacetate trihydrate | 100.0 | 140.0 |
| Disodium ethylene-diaminetetraacetate | 10.0 | 11.0 |
| Ammonium bromide | 140.0 | 180.0 |
| Ammonium nitrate | 30.0 | 40.0 |
| Ammonia water (27%) | 6.5 ml | 2.5 ml |
| Water to make | 1.0 l | 1.0 l |
| pH | 6.0 | 5.5 |
| Fixing Solution: | | |
| Disodium ethylene-diaminetetraacetate | 0.5 | 1.0 |
| Sodium sulfite | 7.0 | 12.0 |
| Sodium bisulfite | 5.0 | 9.5 |
| Ammonium thiosulfate aqueous solution (70%) | 170.0 ml | 240.0 ml |
| Water to make | 1.0 l | 1.0 l |
| pH | 6.7 | 6.6 |

(Washing Solution )

Tap water was supplied to a mixed-bed column filled with an H type strongly acidic cation exchange resin (Amberlite IR-120B: available from Rohm & House Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 1.5 g/l of sodium sulfate were added. The pH of the solution fell within the range of 6.5 to 7.5.

| Stabilizing Solution: | Mother Solution (g) | Replenishment Solution (g) |
|---|---|---|
| Formalin (37%) | 2.0 ml | 3.0 ml |
| Polyoxyethylene-p-monononylphenylether (average polymeri-zation degree = 10) | 0.3 | 0.45 |
| Disodium ethylene-diaminetetraacetate | 0.05 | 0.08 |
| Water to make | 1.0 l | 1.0 l |
| pH | 5.0–8.0 | 5.0–8.0 |

The magenta density and the cyan density of the developed film were measured, and the sensitivity and the fog of each sample were obtained. The sensitivity is represented by a reciprocal of an exposure amount for giving a density of fog+0.2 and is a relative value assuming that the sensitivity of the sample 101 is 100. These results are summarized in Table 5.

TABLE 5

| Sample No. | Sensitivity of red-sensitive layer | Fog of red sensitive layer | Sensitivity of green-sensitive layer | Fog of green-sensitive layer |
|---|---|---|---|---|
| 101 (Comparative Example) | 100 | 0.25 | 100 | 0.60 |
| 102 (Present Invention) | 125 | 0.27 | 97 | 0.60 |
| 103 (Comparative Example) | 110 | 0.25 | 90 | 0.58 |
| 104 (Present Invention) | 110 | 0.25 | 130 | 0.60 |

The sensitivity of the red-sensitive layer of the sample 102 was higher than that of the sample 101, and the sensitivity of the green-sensitive layer of the sample 104 was higher than that of the sample 103.

TABLE A (a) 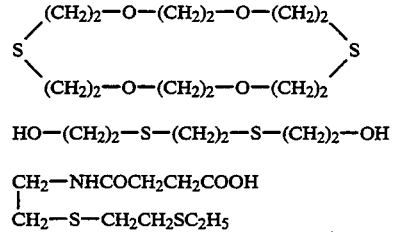

(b) 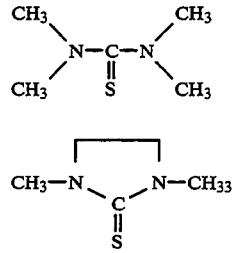

(c) 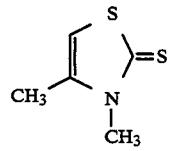

(d) 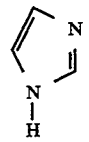

(e) $K_2SO_3$ (f) $NH_4SCN$
KSCN

TABLE B

EX-1 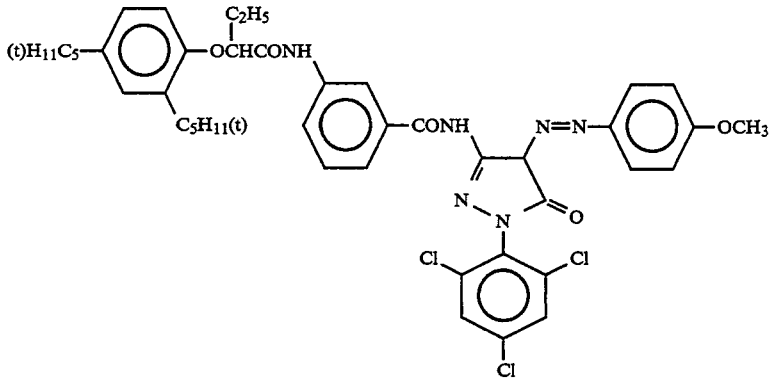

EX-2 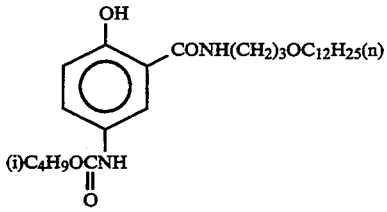

TABLE B-continued
Ex-3
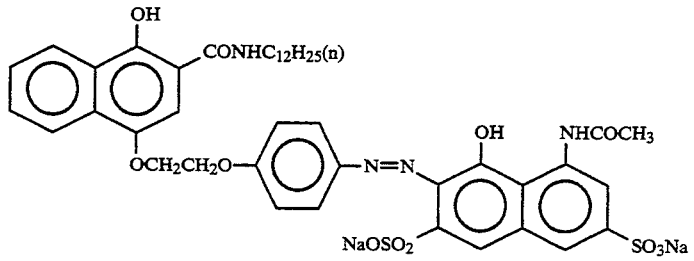
EX-4
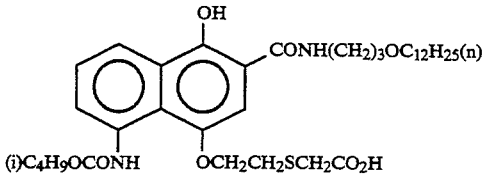
EX-5
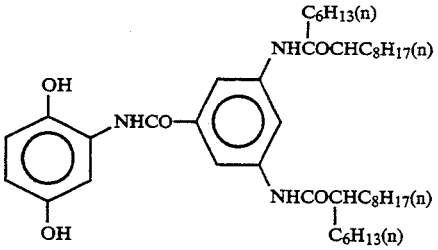
EX-6
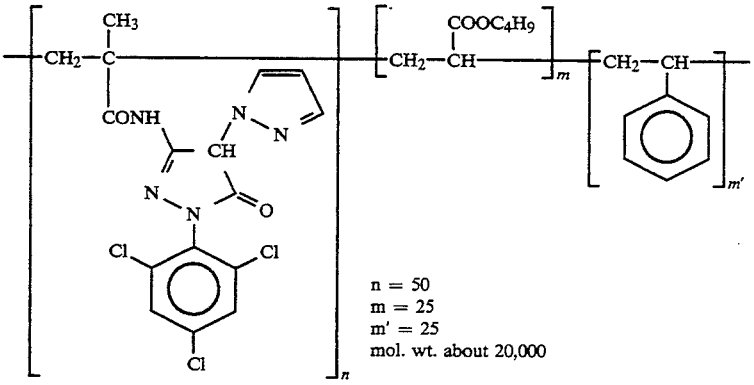
EX-7
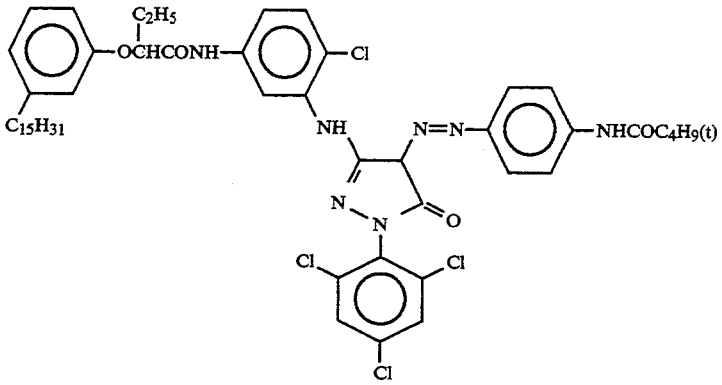

TABLE B-continued
EX-8
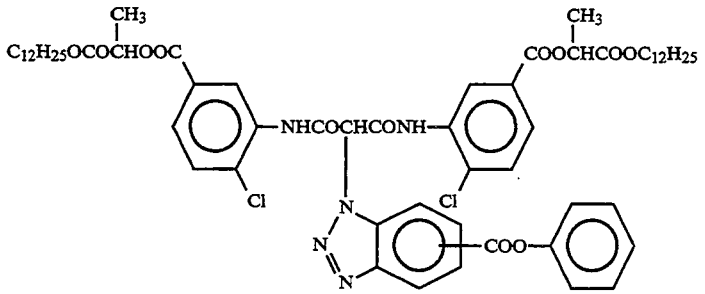
EX-9
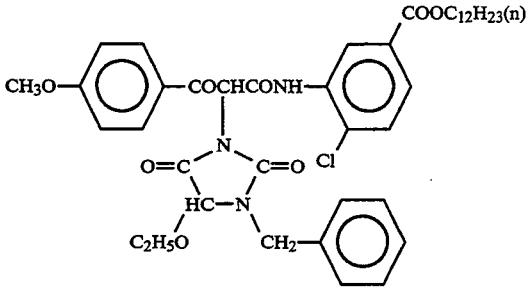
EX-10
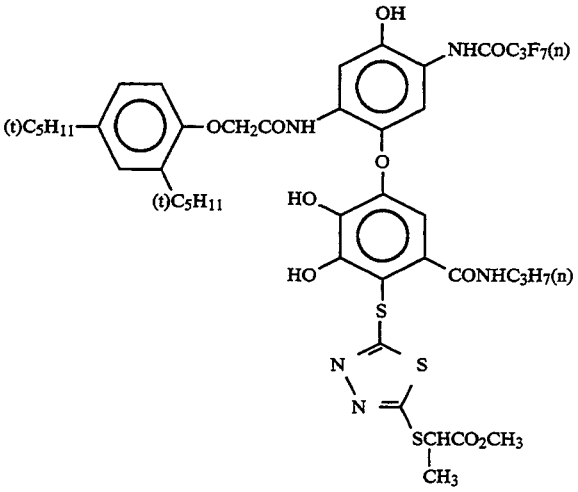
EX-11
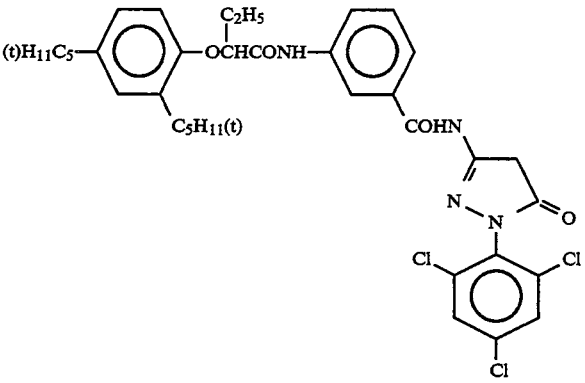
EX-12
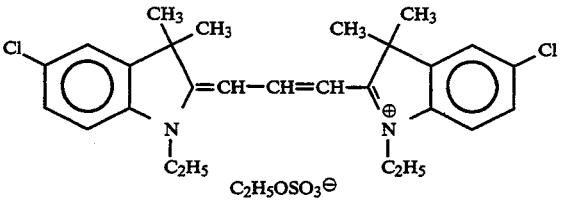

TABLE B-continued
EX-13
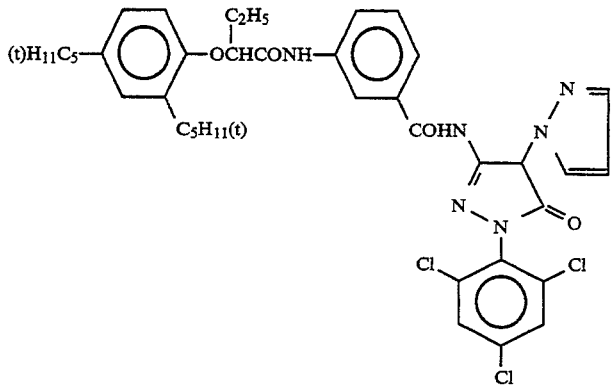
U-1
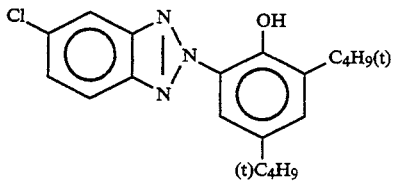
U-2
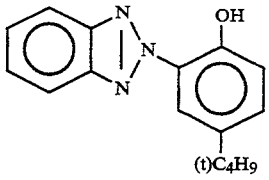
U-3
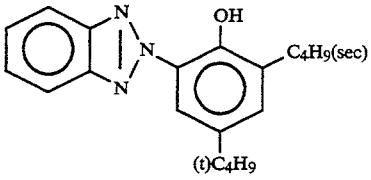
U-4
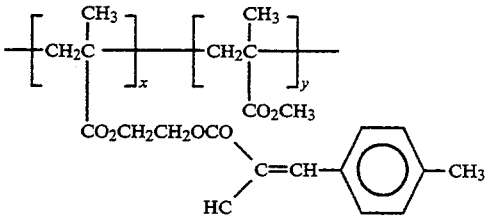
X:Y = 70:30 (wt %)
UV-5
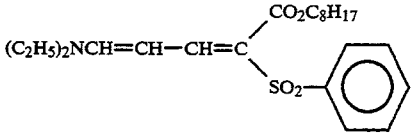
HBS-1 tricresyphosphate
HBS-2 di-n-butylphtalate
HBS-3
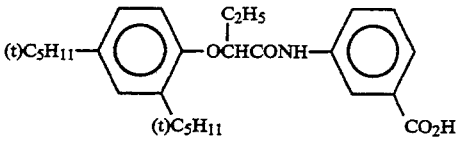

TABLE B-continued
Sensitizing dye I
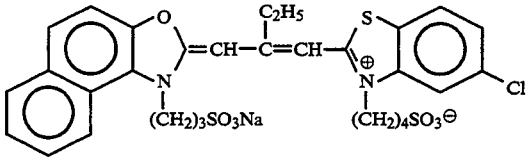
Sensitizing dye II
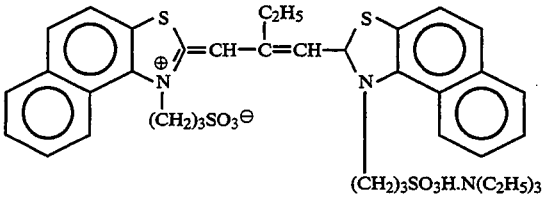
Sensitizing dye III
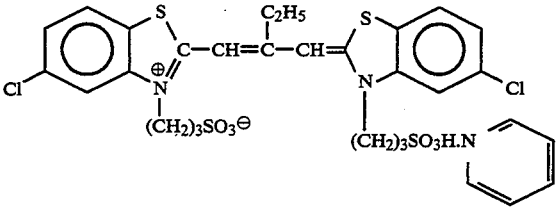
Sensitizing dye IV
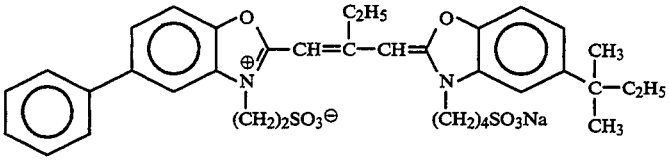
Sensitizing dye V
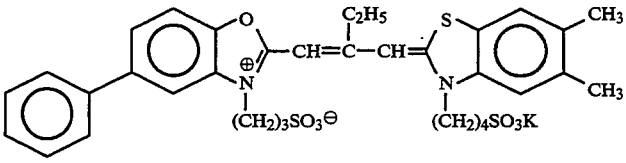
Sensitizing dye VI
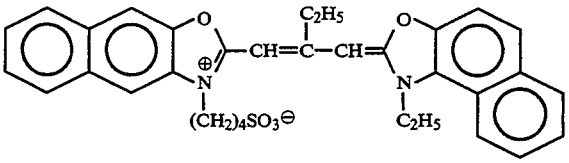
Sensitizing dye VII
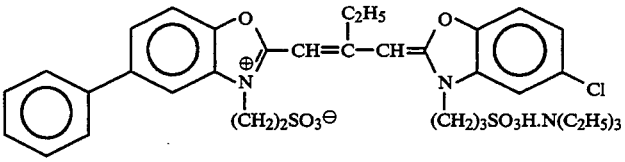
Sensitizing dye VIII
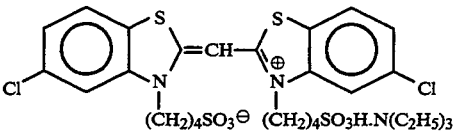
S-1
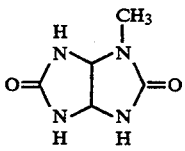

TABLE B-continued

| | |
|---|---|
| H-1 | $CH_2{=}CH{-}SO_2{-}CH_2{-}CONH{-}CH_2$<br>$CH_2{=}CH{-}SO_2{-}CH_2{-}CONH{-}CH_2$ |
| EX-14 | 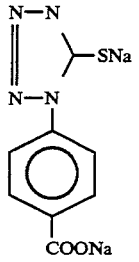 |
| EX-15 | 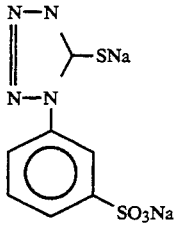 |
| EX-16 | Copolymer of polyvinylpyrrolidone and polyvinylalcohol |
| EX-17 | 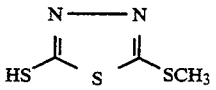 |
| EX-18 | 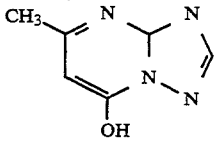 |
| EX-19 | 1,2-benzisothiazoline-3-one |
| EX-20 | n-butyhl-p-hydroxybenzoate |
| EX-21 | 2-phenoxyethanol |
| EX-22 | 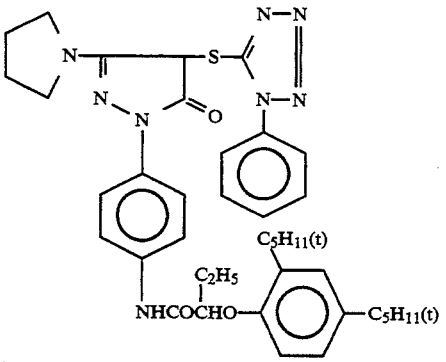 |

What is claimed is:

1. A silver halide photographic light-sensitive material comprising, on a support, at least one negative silver halide emulsion layer containing tabular silver iodobromide grains which are subjected to selenium sensitization and gold sensitization, have at least one peak value in internal sensitivity speck numbers in a distribution of sensitivity specks, the peak value being present at a depth of 2 nm to less than 50 nm from the surface of the grains, and have an average aspect ratio of more than 3 and less than 8.

2. The material according to claim 1, wherein said grains are further subjected to sulfur sensitization.

3. The silver halide photographic light-sensitive material according to claim 1, wherein the silver halide grains have a sensitivity speck number at the surface, which is about 1/10 to 5/10 of the peak value in internal sensitivity speck numbers.

4. The silver halide photographic light-sensitive material according to claim 1, wherein the variation coefficient in the sizes of said silver halide grains, represented by the circle-equivalent diameter of the projected area, is 20% or less.

5. The silver halide photographic light-sensitive material according to claim 1, wherein said silver halide grains have dislocations.

6. The silver halide photographic light-sensitive material according to claim 1, wherein said silver halide grains have at least one peak value in internal sensitivity speck numbers at a depth of 5 nm to 30 nm from the surface of the grains.

7. The silver halide photographic light-sensitive material according to claim 1, wherein the tabular grains have a diameter of 0.15 to 0.5 μm.

8. The silver halide photographic light-sensitive material according to claim 1, wherein the tabular grains have a thickness of 0.05 to 1.0 μm.

9. The silver halide photographic light-sensitive material according to claim 1, wherein a ratio occupied by tabular grains is 50% or more of the entire projected area.

10. The silver halide photographic light-sensitive material according to claim 1, wherein the tabular grains are monodisperse.

11. The silver halide photographic light-sensitive material according to claim 1, wherein the silver halide grains have a halogen-converted silver halide, silver thiocyanate, or silver citrate layer inside the grain.

12. The silver halide photographic light-sensitive material according to claim 1, wherein the selenium sensitization is with a labile selenium sensitizer.

13. The silver halide photographic light-sensitive material according to claim 1, wherein the selenium sensitization is with an un-labile selenium sensitizer.

14. The silver halide photographic light-sensitive material according to claim 1, wherein an addition amount of the selenium sensitizer is $1\times10^{-8}$ mol or more per mol of silver halide.

15. The silver halide photographic light-sensitive material according to claim 2, wherein an addition amount of the sulfur sensitizer is $1\times10^{-7}$ to $5\times10^{-5}$ mol per mol of silver halide.

16. The silver halide photographic light-sensitive material according to claim 2, wherein an addition amount of gold sensitizer is $1\times10^{-7}$ to $5\times10^{-5}$ mol per mol of silver halide.

* * * * *